US008197297B2

(12) United States Patent
Shimizu

(10) Patent No.: US 8,197,297 B2
(45) Date of Patent: Jun. 12, 2012

(54) TOY BUILDING BLOCK

(75) Inventor: Kiyoshi Shimizu, Osaka (JP)

(73) Assignee: Kokuyo Co., Ltd., Osaka (JP)

( * ) Notice: Subject to any disclaimer, the term of this patent is extended or adjusted under 35 U.S.C. 154(b) by 184 days.

(21) Appl. No.: 12/743,136

(22) PCT Filed: Oct. 20, 2008

(86) PCT No.: PCT/JP2008/068966

§ 371 (c)(1),
(2), (4) Date: May 14, 2010

(87) PCT Pub. No.: WO2009/066527

PCT Pub. Date: May 28, 2009

(65) Prior Publication Data

US 2010/0261402 A1 Oct. 14, 2010

(30) Foreign Application Priority Data

Nov. 20, 2007 (JP) ..... 2007-301030

(51) Int. Cl.
*A63H 33/08* (2006.01)

(52) U.S. Cl. ..... 446/114; 446/124

(58) Field of Classification Search ..... 446/107–109, 446/111, 113–114, 116–122, 124, 125; 273/DIG. 24, 157 R
See application file for complete search history.

(56) References Cited

U.S. PATENT DOCUMENTS 3,562,077 A * 2/1971 Raba ..... 428/12
3,698,124 A * 10/1972 Reitzel et al. ..... 446/114
3,940,100 A * 2/1976 Haug ..... 248/188.1
4,787,191 A 11/1988 Shima
5,171,014 A * 12/1992 Hsieh ..... 273/157 R
6,149,487 A * 11/2000 Peng ..... 446/114

FOREIGN PATENT DOCUMENTS

JP S 33-008949 Y1 6/1958
JP S 35-002750 Y1 2/1960
JP S 51-051097 U 4/1976
JP S 52-027396 U 2/1977
JP S 55-138998 U 10/1980
JP S 56-097696 U 12/1981

(Continued)

OTHER PUBLICATIONS

Examiner's Report issued in counterpart Australian Application No. 2008327315 dated Nov. 18, 2009 (2 Pages).

(Continued)

*Primary Examiner* — Nini Legesse

(74) *Attorney, Agent, or Firm* — Fitch Even Tabin & Flannery, LLP

(57) ABSTRACT

The disclosure discloses a toy building block that can create a cubic article by assembling a unit piece, the unit piece comprising: a plate body made of a flexible material in which an outer profile of the plate body is formed by a pair of upper and lower short sides curved inward and a pair of right and left long sides curved inward; projections provided at a corner portions located on one of diagonal lines of the plate body on a plate face of the plate body at a right angle; and through holes into which the projections can be fitted, the through holes being provided at the corner portions located on the other diagonal line of the plate body.

5 Claims, 5 Drawing Sheets

FOREIGN PATENT DOCUMENTS

JP S 63-011911 U 1/1988

OTHER PUBLICATIONS

Office Action issued in counterpart Japanese Application No. 2007-301030 dated Jun. 22, 2009 (3 pages) and an English translation of the same (2 pages).

English translation of the International Preliminary Report on Patentability (Chapeter I or Chapter II of the Patent Cooperation Treaty) from the International Bureau of WIPO for International Application No. PCT/JP2008/068966 dated Jun. 17, 2010, 5 pages.

Office Action issued in counterpart Canadian Application No. 2,705,185 dated Feb. 3, 2012 (3 pages).

* cited by examiner

[FIG. 1A]
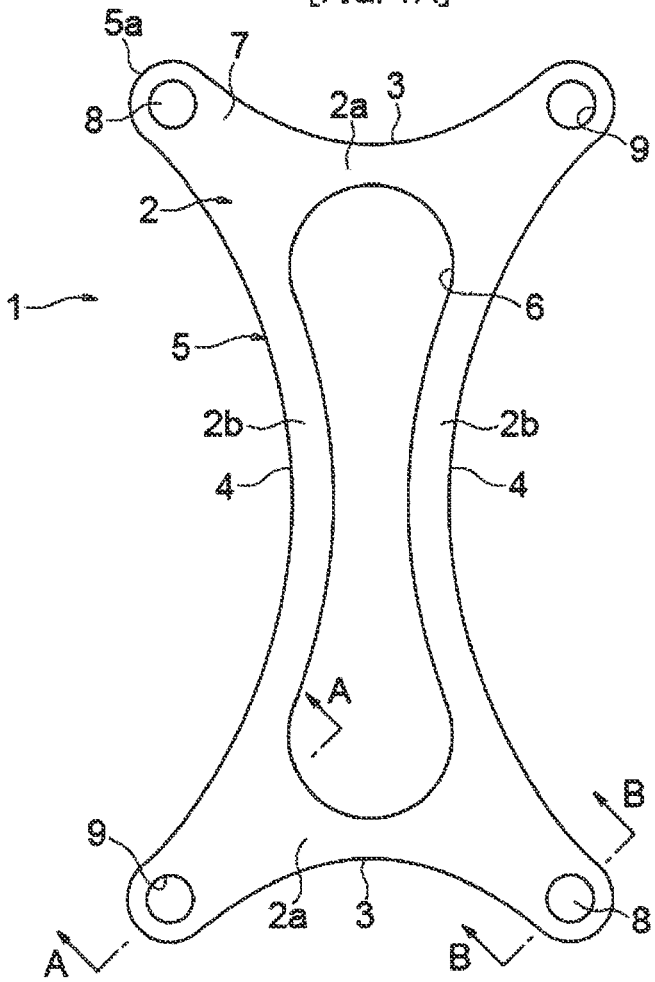
[FIG. 1B]
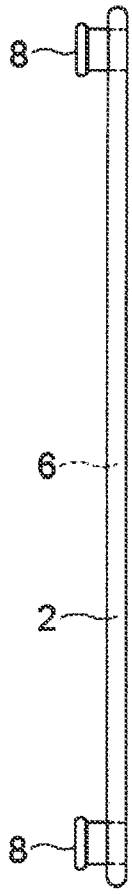
[FIG. 1C]
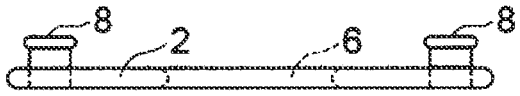
[FIG. 2A]
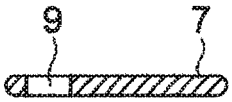
[FIG. 2B]
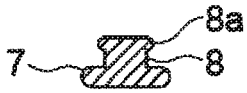

[FIG. 3A]
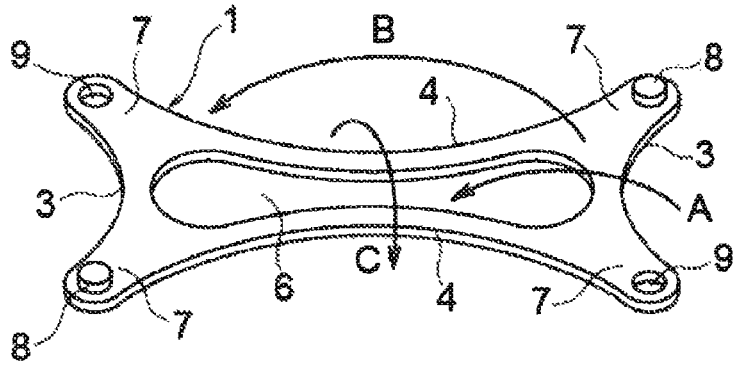
[FIG. 3B]
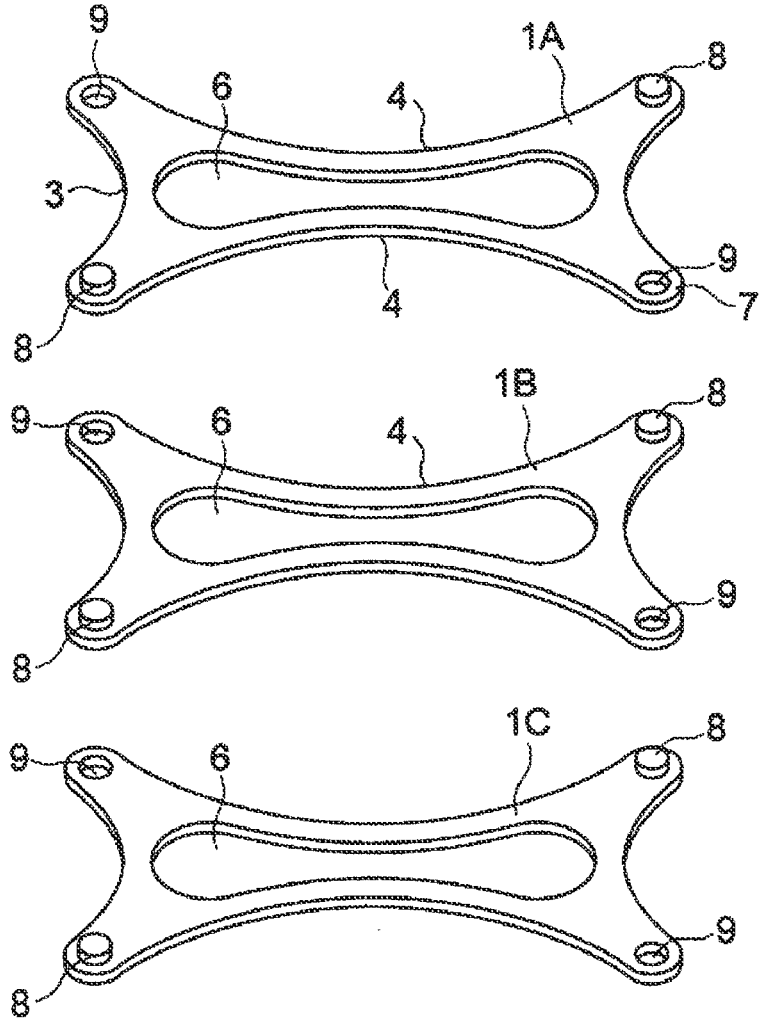

[FIG. 4A]
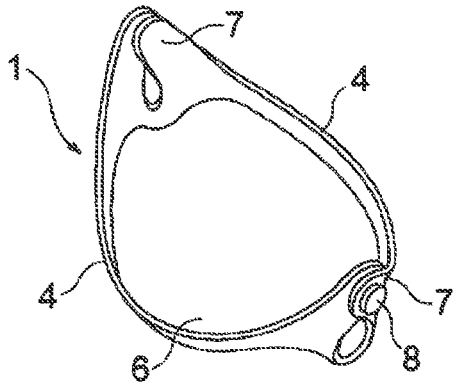
[FIG. 4B]
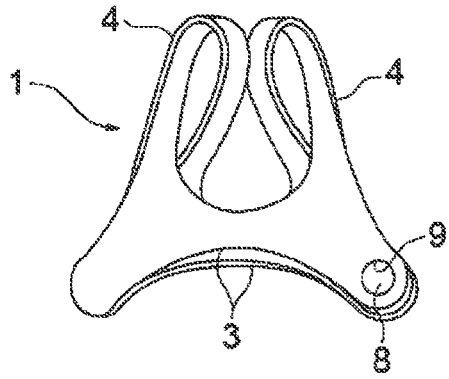
[FIG. 4C]
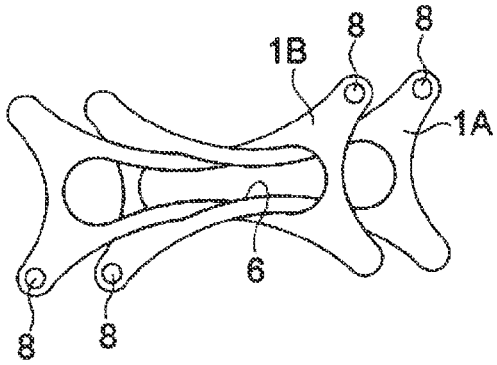
[FIG. 4D]
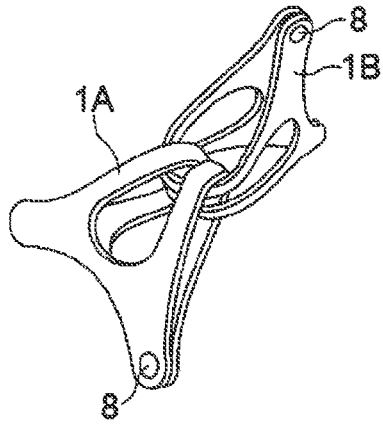
[FIG. 4E]
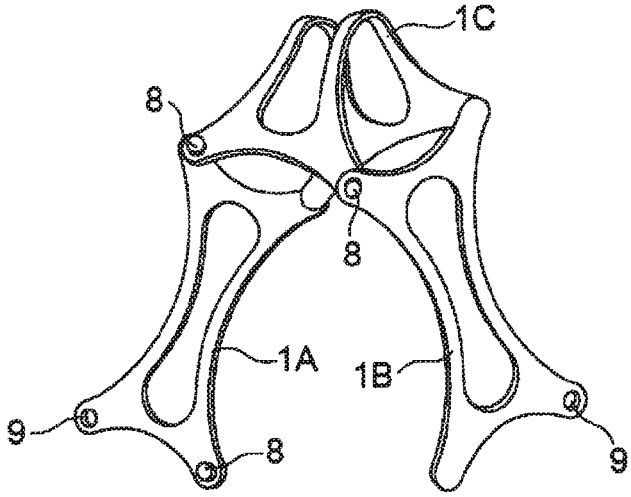

[FIG. 5]
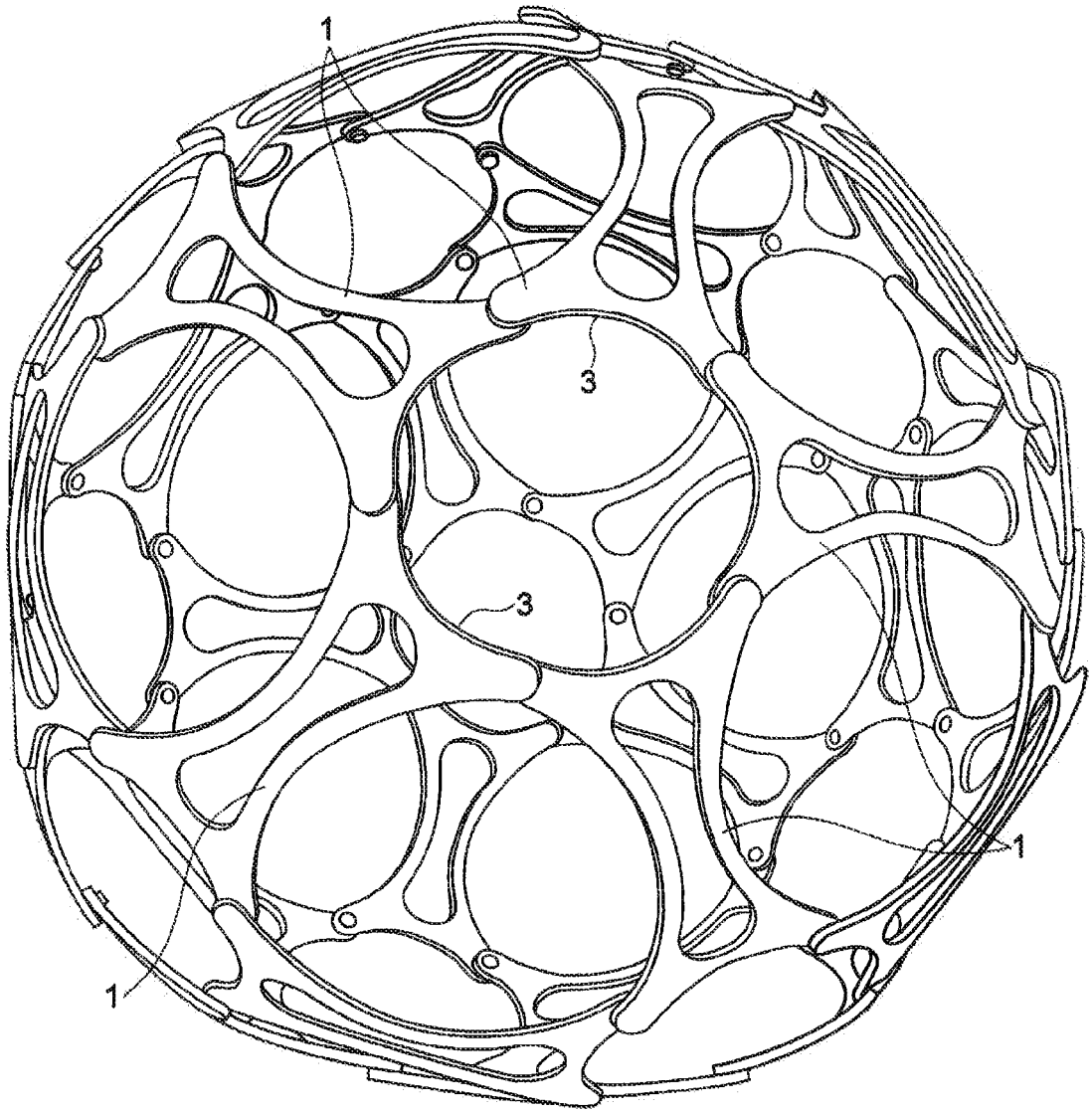

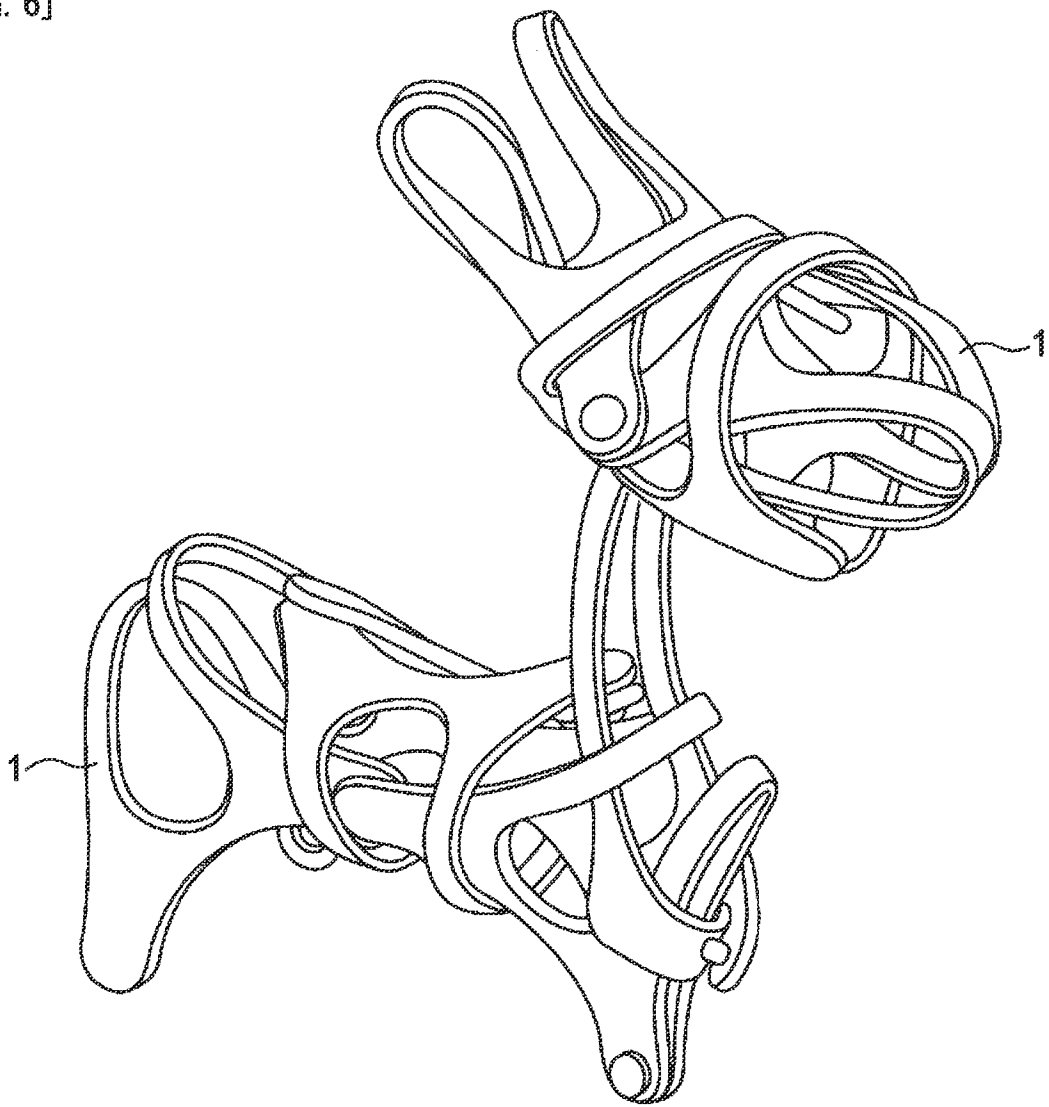
[FIG. 6]

TOY BUILDING BLOCK

CROSS-REFERENCE TO RELATED APPLICATION

This is an application PCT/JP2008/68966, filed Oct. 20, 2008, which was not published under PCT article 21(2) in English.

BACKGROUND OF THE INVENTION

1. Field of the Invention

The present invention relates to a toy building block that can create various types of not only planar but cubic articles by assembling unit pieces with originality and ingenuity and is suitable for fostering creativity in formative design for children while enjoying the activity.

2. Description of the Related Art

A block toy has been known in which one or a plurality of types of blocks are assembled using a recess and a projection and the like so as to create cubic articles such as a polygonal body, a container, a boat, a castle, a house, a wall face and the like.

According to this type of block toy, children can foster creativity in formative design while enjoying it but assembling of blocks can hardly create a curved face, and there is a defect that created cubic articles are limited to relatively simple ones in which mainly planes are combined.

On the other hand, as a toy building block with improved expressive capacity of cubic articles, such a toy is proposed in which pieces made of a metal plate are used, a length of one side of plural types of regular polygons is made the same, regardless of the number of sides, a projecting piece is projected at the center of each side, and a slit through which the projecting piece can be inserted is provided at a root of the projecting piece (See Japanese Patent Application JP S 56-097696 U (FIG. 1), for example).

According to this toy building block, by abutting one face of each of two pieces to each other at sides, inserting a projecting piece on the side of one of the pieces into a slit in the side of the other piece, and bending a distal-end portion of the projecting piece, the two pieces can be assembled with the sides abutted to each other, and moreover, since an angle between the faces of the two pieces can be arbitrarily changed, a curved face can be expressed by continuing the faces, and a spherical body such as a soccer ball using a plurality of types of pieces such as a regular triangle, a regular tetragon, and a regular hexagon.

However, with regard to the above-proposed toy building block, since the piece is constructed by a rigid plate, there is a problem that complicated assembling such as twisting or bending the piece so as to assemble it to another piece or the like is totally impossible, and the capacity of expression of cubic articles is still low.

SUMMARY OF THE INVENTION

Therefore, an object of the present invention is to provide a toy building block with a simple structure capable of assembling complicated forms of pieces such as twisting and bending the piece and assembling it to another piece and realize high capacity of expression of cubic articles.

Another object of the present invention is to provide a toy building block with a simple structure capable of assembling more complicated forms of pieces such as having another piece go through one piece so as to connect the another piece to the one piece or to still another piece and realize higher capacity of expression of cubic articles.

To achieve the above-described problem, the first invention is a toy building block that can create a cubic article by assembling a unit piece, the unit piece comprising: a plate body made of a flexible material in which an outer profile of the plate body is formed by a pair of upper and lower short sides curved inward and a pair of right and left long sides curved inward; projections provided at a corner portions located on one of diagonal lines of the plate body on a plate face of the plate body at a right angle; and through holes into which the projections can be fitted, the through holes being provided at the corner portions located on the other diagonal line of the plate body.

According to a first invention, since a unit piece is constructed by a plate material made of a flexible material having an outer profile with right and left and upper and lower long and short sides curved inward, the piece can be deformed in various ways by bending or folding the piece in the longitudinal direction, twisting the piece around an axis in the longitudinal direction or in the width direction, bending or folding the piece in the width direction and the like, and by assembling a plurality of pieces 1, they are easily extended from two dimensional to three dimensional so that a cubic article can be created. As a result, by assembling unit pieces with originality and ingenuity, a wide variety of cubic articles including planar cubic articles such as a spherical body, an animal, an insect, a vase, a tapestry and the like can be created, and not only children can foster creativity in formative design while enjoying it but adults can also enjoy it. Also, the unit piece has a simple shape and a simple structure, and since the toy building block is constituted by the one type of unit piece, its constitution is simple.

The second invention is featured by that in the above-described first invention the plate body is formed in a frame shape in which a gourd-shaped opening substantially following the outer profile is opened on an inner side of the plate body.

As a result, assembling of more complicated forms of pieces such as having a short side of the piece go into an opening or having another piece go through one piece so as to connect the another piece to the one piece or to still another piece and the like is made possible and higher capacity of expression of cubic articles can be realized.

The third invention is featured by that in the above-described first invention the corner portion is formed to have a substantially circular outer profile.

As a result, smooth assembling of the unit piece is made possible

The fourth invention is featured by that in the above-described first invention the projection has a length such that a head portion is exposed from the through hole, and the head portion is extended outward in a radial direction.

As a result, when the pieces are connected through fitting between a projection and a through hole, removal of the projection from the through hole is prevented by locking at a head portion, and the pieces can be firmly assembled.

The fifth invention is featured by that in the above-described first invention a plurality of the unit pieces classified into a plurality of piece groups, each of the piece groups having an own color different from the other piece group.

As a result, an appearance of a cubic article by the unit pieces is improved, and the capacity of expression is further improved.

According to the present invention, not only simple alignment and connection but also connection of pieces in complicated forms are possible by twisting or bending the piece or having another piece go through the piece and the like, and a toy building block capable of constructing cubic articles even with a simple structure and of fostering high capacity of expression and imagination can be provided.

BRIEF DESCRIPTION OF THE DRAWINGS

FIGS. 1A-1C are a plan view (FIG. 1A), a right side view (FIG. 1B), and a bottom view (FIG. 1C) illustrating a unit piece according to an embodiment of a toy building block of the present invention.

FIGS. 2A and 2B are a B-B sectional view (FIG. 2A) and an A-A sectional view (FIG. 2B) of FIG. 1A.

FIGS. 3A and 3B are a perspective view for explaining deformation and a connecting method of the unit piece in FIG. 1.

FIGS. 4A-4E are perspective views illustrating some examples of the cubic article by the unit piece in FIG. 1

FIG. 5 is a perspective view illustrating a creation example of a spherical body by the unit piece in FIG. 1.

FIG. 6 is a perspective view illustrating a creation example of a horse by the unit piece in FIG. 1.

DETAILED DESCRIPTION OF THE PREFERRED EMBODIMENTS

An embodiment of a toy building block of the present invention will be described below in detail referring to the attached drawings. FIG. 1A-1C are diagrams illustrating a unit piece in the embodiment of the toy building block of the present invention, in which FIG. 1A is a plan view, FIG. 1B is a right side view, and FIG. 1C is a bottom view.

The toy building block of the present invention is used so that a cubic article is created by assembling unit pieces 1 as shown in FIGS. 1A-1C to each other.

In this embodiment, the unit piece 1 is made up of a plate material 2 made of a flexible material having an outer profile 5 formed by a pair of upper and lower short sides 3 curved inward and a pair of right and left long sides 4 curved inward and imparted with properties capable of being twisted and bent. In order to improve twisting performance and bending performance of the piece 1 and to enable another piece to go through the piece 1, a gourd-shaped opening 6 substantially following the outer profile 5 is opened in a plate body 2, and the plate body 2 is formed in a frame-shaped plate body. This opening 6 is opened so that frame portions 2*a* and frame portions 2*b* remain between the opening 6 and the upper and lower short sides 3 as well as the right and left long sides 4, respectively, and the upper and lower frame portions 2*a* are formed in a band shape which is the narrowest at the center part in the width direction of the plate body 2, while the right and left frame portions 2*b* are formed in the band shape following the right and left long sides 4.

Four corners of the plate body 2 are extended outward in the diagonal directions of the plate body 2 and formed into corner portions 7 having substantially circular outer profiles 5*a* continuing to the short side 3 and the long side 4. At the corner portions 7 located on one of the diagonal lines on the plate body 2, as shown in a B-B section of FIG. 1A in FIG. 2A, cylindrical projections 8 are provided at a right angle on a plate face of the plate body 2, while at the corner portions 7 located on the other diagonal line of the plate body 2, as shown in an A-A section of FIG. 1A in FIG. 2B, cylindrical through holes 9 with which the projections 8 can be fitted are provided. The projection 8 preferably has a length protruding from the through hole 9, and a head portion 8*a* of the projection 8 is extended outward in the radial direction. As a result, when the two pieces 1 are connected through fitting between the projections 8 and the through holes 9, removal of the projection 8 from the through hole 9 is prevented by locking by the head portion 8*a*, and the two pieces 1 can be firmly assembled.

An example of specification of the unit piece 1 will be shown. A plate thickness of the piece 1 is 1.5 mm, a width of the piece 1 between the right and left corner portions 7 is 36.6 mm and 12.5 mm at the center part in the longitudinal direction, a length of the piece 1 is 66.6 mm between the upper and lower corner portions 7 and 54.2 mm at the center part in the width direction. A radius of curvature of the short side 3 of the piece 1 is 17.9 mm, while a radius of curvature of the long side 4 is 39.1 mm. A width of the opening 6 of the piece 1 is 5.7 mm at the center part in the longitudinal direction and a length at the center in the width direction is 48.2 mm, a radius of curvature of the opening 6 is 42.1 mm at an edge portion along the long side 4 and 6.3 mm at the edge portion opposing the short side 3. A diameter of the projection 8 of the piece 1 is 3.3 mm, a length to the head portion 8*a* is 2.4 mm, a diameter of a head portion 8*a* is 3.6 mm, a length is 0.8 mm, and a diameter of the through hole 9 is 3.3 mm and a length is 1.5 mm (equal to the plate thickness). It is needless to say that the dimensions are not limiting, and more diversified combinations are possible by combining various sizes of pieces. As a material of the piece 1, plastic with flexibility such as polymer, elastomer and the like is used, and in this embodiment, the piece 1 is manufactured by soft polyethylene.

The toy building block of this embodiment is provided with the unit pieces 1 in a single color or the unit pieces in plural colors such as red, blue, yellow, green and the like. Since the unit piece 1 is constituted by the plate material 2 made of a flexible material having the outer profile 5 with the right and left and upper and lower long and short sides curved inward, and moreover, the gourd-shaped opening 6 substantially following the outer profile 5 is opened in the plate member 2, the piece 1 can be deformed in various ways by bending or folding the piece 1 in the longitudinal direction, having the short side 3 side of the piece 1 go into the opening 6, twisting the piece 1 around an axis in the longitudinal direction or in the width direction, bending or folding the piece 1 in the width direction and the like, and by assembling the plurality of pieces 1, they are easily extended from two dimensional to three dimensional so that a cubic article can be created, and not only a curved-face article such as a spherical face but also cubic articles in any shape can be created.

For example, some examples of deformation of the single piece 1 will be shown. As shown by an arrow A in FIG. 3A, by inserting one of the short side 3 sides into the opening 6 of the piece 1 in the longitudinal direction so as to go through the opening 6 and by pulling out the short side 3 side having gone through to the original direction, the piece 1 can be twisted (Example 1).

In the above described example 1, by not pulling out the one of the short side 3 sides having gone through the opening 6 of the piece 1 to the original direction but bending and opposing it to the other short side 3 side, the projection 8 and the through hole 9 on the one short side 3 can be fitted with the through hole 9 and the projection 8 on the other short side 3 (Example 2). A cubic article obtained by that is shown in FIG. 4B.

As shown by an arrow B in FIG. 3A, by bending the piece 1 in the longitudinal direction so as to oppose the short sides 3 to each other, the projection 8 and the through hole 9 on one of the short sides 3 can be fitted with the through hole 9 and the projection 8 on the other short side 3 (Example 3).

In the above described example 3, by twisting the corner portion 7 on one of the opposing short sides 3, the projection 8 and the through hole 9 on one of the short sides 3 can be fitted with the through hole 9 and the projection 8 on the other short side 3 (Example 4).

As shown by an arrow C in FIG. 3C, by bending the piece 1 in the width direction so as to oppose the long sides 4 to each other, the projection 8 and the through hole 9 on one of the long sides 3 can be fitted with the through hole 9 and the projection 8 on the other long side 3 (Example 5).

In the above described example 5, by twisting the corner portion 4 on one of the opposing long sides 4, the projection 8 and the through hole 9 on one of the long sides 4 can be fitted with the through hole 9 and the projection 8 on the other long side 4 (Example 6). A cubic article obtained by that is shown in FIG. 4A.

By twisting the piece 1 around an axis in the longitudinal direction so that one of the short side 3 sides is turned upside down and then, by folding the piece 1 in the diagonal direction, the projection 8 on one of the short sides 3 can be fitted with the through hole 9 on the other short side 3 (Example 7).

By bending the piece 1 in the diagonal direction, the projection 8 on the one of the short side 3 sides and the projection 8 on the other short side 3 side can be twisted in a mode in which they are opposed to each other outward or inward (Example 8). Using the second and third pieces 1 to this twisted piece 1 and by fitting the through hole 9 and the projection 8 on one of the short side 3 sides of the second piece 1 with the projection 8 on the one of short side 3 sides and the through hole 9 on the other short side 3 side of the first piece 1 and by fitting the through hole 9 and the projection 8 on one of the short side 3 sides of the third piece 1 with the projection 8 on the one of the short side 3 sides and the through hole 9 on the other short side 3 side of the first piece 1, a cubic article substantially keeping the twisted shape of the first piece 1 can be formed. This cubic article is shown in FIG. 4E. In FIG. 4E, a piece 1C shows the first piece, pieces 1A and 1B show the second and third pieces, respectively.

To the piece 1 in the twisted state of the above described example 8, the projection 8 on the one of the short side 3 sides of the piece 1 and the projection 8 on the other short side 3 side may be twisted in a mode opened in a separating direction from the opposing position (Example 9). By using the second and third pieces 1 to the twisted piece 1, by fitting the through hole 9 on one of the short side 3 sides of the second piece 1 with the projection 8 on one of the short side 3 sides of the first piece 1 and by fitting the through hole 9 on one of the short side 3 sides of the third piece 1 with the projection 8 on the other short side 3 side of the first piece 1, and moreover, by fitting the projection 8 and the through hole 9 on the other short side 3 sides of the second and third pieces 1, a cubic article substantially keeping the twisted shape of the first piece 1 can be formed.

Some of assembling examples of the pieces 1 will be as follows. For convenience, in FIG. 3B, the plurality of pieces 1 are displayed as pieces 1A, 1B, and the like.

In FIG. 3B, the piece 1B is made to go through the opening 6 of the piece 1A in the longitudinal direction. The direction of the projection 8 may be such that the projections of the pieces 1A and 1B protrude in the same direction or protrude in a separating direction from each other (Example 10). A cubic article obtained by that is shown in FIG. 4C.

By having the piece 1B go through the opening 6 of the piece 1A in a perpendicular direction, the connection of the above described example 3 is formed by each of the pieces 1A and 1B (Example 11). A cubic article obtained by that is shown in FIG. 4D.

According to the operation of the above described example 2 for the pieces 1A and 1B, after the one of the short side 3 sides is made to go through the opening 6 of the piece 1 and bent to the other short side 3 side, while the projection 8 and the through hole 9 of one of the short sides 3 is not fitted with the through hole 9 and the projection 8 on the other short side 3 in each piece 1, the projection 8 and the through hole 9 of one of the short sides 3 is fitted with the through hole 9 and the projection 8 of the other short side 3 of the other piece 1, respectively (Example 12).

The pieces 1A and 1B are aligned in the longitudinal direction and overlapped so that the corner portions 7 of the short sides 3 of the opposing pieces 1A and 1B are alternated horizontally, and the projection 8 and the through hole 9 of the short side 3 in the piece 1A, which is one of them, are fitted with the projection 8 and the through hole 9 of the short side 3 in the other piece 1B so as to connect the pieces 1A and 1B to each other in the longitudinal direction. By repeating this for the piece 1C and after, a lengthy article in which the pieces 1A, 1B, 1C, and the like are connected in the longitudinal direction (Example 13).

Similarly, the pieces 1A and 1B are aligned in the width direction and overlapped so that the corner portions 7 of the long sides 4 of the opposing pieces 1A and 1B are alternated vertically, and the projection 8 and the through hole 9 of the long side 4 of the piece 1A, which is one of the pieces, is fitted with the projection 8 and the through hole 9 of the long side 4 of the other piece 1B so as to connect the pieces 1A and 1B to each other in the width direction. By repeating this for the piece 1C and after, a lengthy article in which the pieces 1A, 1B, 1C, and the like are connected in the width direction (Example 14).

The projection 8 of one of the short sides 3 of the piece 1A is fitted with the through hole 9 of one of the short sides 3 of the piece 1B so as to be connected, and this is repeated for the piece 1C and after so that five pieces 1A are connected on one of the short side 3 sides annularly. Using them as a single set, by assembling an annular article of the five pieces, a spherical body in a soccer ball shape is obtained (Example 15). The spherical body is shown in FIG. 5.

The projection 8 on one of the short sides 3 of the piece 1A located on the front side of the piece 1B and the through hole 9 on one of the short sides 3 of the piece 1C located on the back side of the piece 1B are fitted and connected at a position close to one of the short sides 3 in the opening 6 of the piece 1B, and this is repeated for the fourth piece and after so that the six pieces 1 are connected on one of the short side 3 sides annularly and then, a connected article which can be used for creation of a curved face is obtained (Example 16).

The four pieces 1 are connected on one of long side 4 sides so as to make them a set of first connected article, the long side 4 of the first connected article is shared, the sets of the first connected article are repeatedly assembled in the longitudinal direction and the circumferential direction in a cylindrical shape, and another four pieces 1 are inserted laterally into the opening 6 of the piece 1 of the first connected article so as to connect the another four pieces 1 on one of the short side 3 sides, and by repeating the sets of this second connected article in the longitudinal direction and the lateral direction and by cylindrically assembling so that a cylindrical gap of the first connected article is filled by the second connected article, a cylindrical vase is obtained (Example 17).

As described above, the toy building block of this embodiment can create a wide variety of cubic articles depending on assembling of the unit pieces 1.

FIGS. 4A-4E show examples of the cubic articles by the toy building block of this embodiment. FIG. 4A is the example 6, FIG. 4B is the cubic article in the example 2, FIG. 4C is the example 10, FIG. 4D is the example 12, and FIG. 4E is the example 8, respectively.

FIG. 5 shows an example of the cubic article by the toy building block of this embodiment. This spherical body is the cubic article in the example 15.

FIG. 6 shows still another example of the cubic article by the toy building block of this embodiment. This cubic article constitutes a horse by the 7 unit pieces 1.

The embodiments of the toy building block of the present invention Explanation has been made using the examples of the cubic articles, but since the toy building block of the present invention is constituted by the plate material made of the flexible material having outer profile with the right and left and upper and lower long and short sides curved inward, the piece can be variously deformed by bending or folding the piece in the longitudinal direction, by twisting the piece around the axis in the longitudinal direction or in the width direction, by bending or folding the piece in the width direction and the like, and by assembling a plurality of pieces, they are easily extended from two dimensional to three dimensional so that a cubic article can be created. As a result, by assembling the unit piece with originality and ingenuity, a wide variety of cubic articles including planar cubic articles such as a spherical body, an animal, an insect, a vase, a tapestry and the like can be created, and not only that children can foster creativity in formative design while enjoying it but also adults can also enjoy it by using them for accessories through combination of the pieces, for example.

Particularly when the gourd-shaped opening substantially following the outer profile is opened inside the plate material, assembling in more complicated forms by having another piece go through one piece and connecting another piece to the one piece or still another piece and the like becomes possible, and capacity of expression of the cubic articles can be further improved.

Also, the shape of the unit piece is structurally simple, and since the toy building block is made up of one type of the unit piece, its constitution is simple. Moreover, by combining large and small pieces in the same shape, a wider variety of cubic articles can be constructed.

What is claimed is:

1. A toy building block that can create a cubic article by assembling a unit piece, said unit piece comprising:

a plate body made of a flexible material in which an outer profile of the plate body is formed by a pair of upper and lower short sides curved inward and a pair of right and left long sides curved inward;

projections provided at a corner portions located on one of diagonal lines of said plate body on a plate face of the plate body at a right angle; and through holes into which said projections can be fitted, the through holes being provided at the corner portions located on the other diagonal line of the plate body.

2. The toy building block according to claim 1, wherein:

said plate body is formed in a frame shape in which a gourd-shaped opening substantially following said outer profile is opened on an inner side of the plate body.

3. The toy building block according to claim 1, wherein:

said corner portion is formed to have a substantially circular outer profile.

4. The toy building block according to claim 1, wherein:

said projection has a length such that a head portion is exposed from said through hole, and the head portion is extended outward in a radial direction.

5. The toy building block according to claim 1, wherein:

a plurality of the unit pieces classified into a plurality of piece groups, each of the piece group having its own color that is different from the other piece group.

* * * * *